US007917053B2

(12) United States Patent
Shibuya et al.

(10) Patent No.: US 7,917,053 B2
(45) Date of Patent: Mar. 29, 2011

(54) IMAGE FORMING AND TONER CLEANING APPARATUS AND METHOD

(75) Inventors: Satoru Shibuya, Chiryu (JP); Yasunori Nakayama, Hoi-gun (JP); Hidetoshi Noguchi, Tahara (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 577 days.

(21) Appl. No.: 11/945,761

(22) Filed: Nov. 27, 2007

(65) Prior Publication Data

US 2008/0131157 A1 Jun. 5, 2008

(30) Foreign Application Priority Data

Nov. 30, 2006 (JP) ..... 2006-323654

(51) Int. Cl.
*G03G 15/16* (2006.01)

(52) U.S. Cl. ..... 399/101

(58) Field of Classification Search ..... 399/100, 399/101, 66, 71, 302, 308
See application file for complete search history.

(56) References Cited

U.S. PATENT DOCUMENTS

| | | | | |
|---|---|---|---|---|
| 5,722,015 | A * | 2/1998 | Tombs | 399/129 |
| 5,991,566 | A * | 11/1999 | Tanaka et al. | 399/101 |
| 6,785,491 | B2 * | 8/2004 | Mitsu et al. | 399/101 |
| 6,879,801 | B2 * | 4/2005 | Soda et al. | 399/302 |
| 7,113,713 | B2 * | 9/2006 | Soda et al. | 399/66 |
| 7,127,191 | B2 * | 10/2006 | Mori et al. | 399/101 |
| 7,215,920 | B2 * | 5/2007 | Shida | 399/354 |
| 7,444,098 | B2 * | 10/2008 | Hamada et al. | 399/101 |
| 2005/0063734 | A1 | 3/2005 | Saito et al. | |
| 2006/0039711 | A1 | 2/2006 | Shibuya et al. | |

FOREIGN PATENT DOCUMENTS

| | | | |
|---|---|---|---|
| JP | 7-219402 A | | 8/1995 |
| JP | 9-138547 (A) | | 5/1997 |
| JP | 2004-310060 (A) | | 11/2004 |
| JP | 2005-62280 A | | 3/2005 |
| JP | 2005-292194 A | | 10/2005 |
| JP | 2005292194 A | * | 10/2005 |
| JP | 2006-58422 A | | 3/2006 |
| JP | 2006-189503 A | | 7/2006 |
| JP | 2006-208761 A | | 8/2006 |
| JP | 2006208761 A | * | 8/2006 |

OTHER PUBLICATIONS

Official Action issued Jan. 19, 2010 by the Japanese Patent Office in corresponding Japanese Patent Application No. 2006-323654 and English language translation.

* cited by examiner

*Primary Examiner* — Robert Beatty
(74) *Attorney, Agent, or Firm* — Buchanan Ingersoll & Rooney PC

(57) ABSTRACT

An image forming apparatus performs an image forming operation and an untransferred toner particles transfer operation. In particular, the image forming apparatus has an image bearing member, the image bearing member having an endless image bearing surface and supported for rotation, a charging member made of a brush provided in contact with the image bearing surface to define a charging region, and a controller. The controller controls the image forming operation in which the toner image is provided to a recording medium and the transfer operation the transfer operation in which the rotation of the image bearing member is halted and then toner particles accumulated in the brush are transferred onto the image bearing surface at the charging region.

12 Claims, 11 Drawing Sheets

PRESSURE CONTACT OF FIRST TRANSFER ROLLER ON BELT
ON
OFF

PRESSURE CONTACT OF SECOND TRANSFER ROLLER ON BELT
ON
OFF

ROTATION DRIVE OF BELT
ON
OFF

ROTATION DRIVE OF CLEANING BRUSH
ON
OFF

APPLICATION OF TONER REMOVING VOLTAGE Vr TO CLEANING BRUSH
ON(+)
OFF

APPLICATION OF CHARGING VOLTAGE Vc TO CHARGING BRUSH
OFF
ON(−)
T1
T2
T3

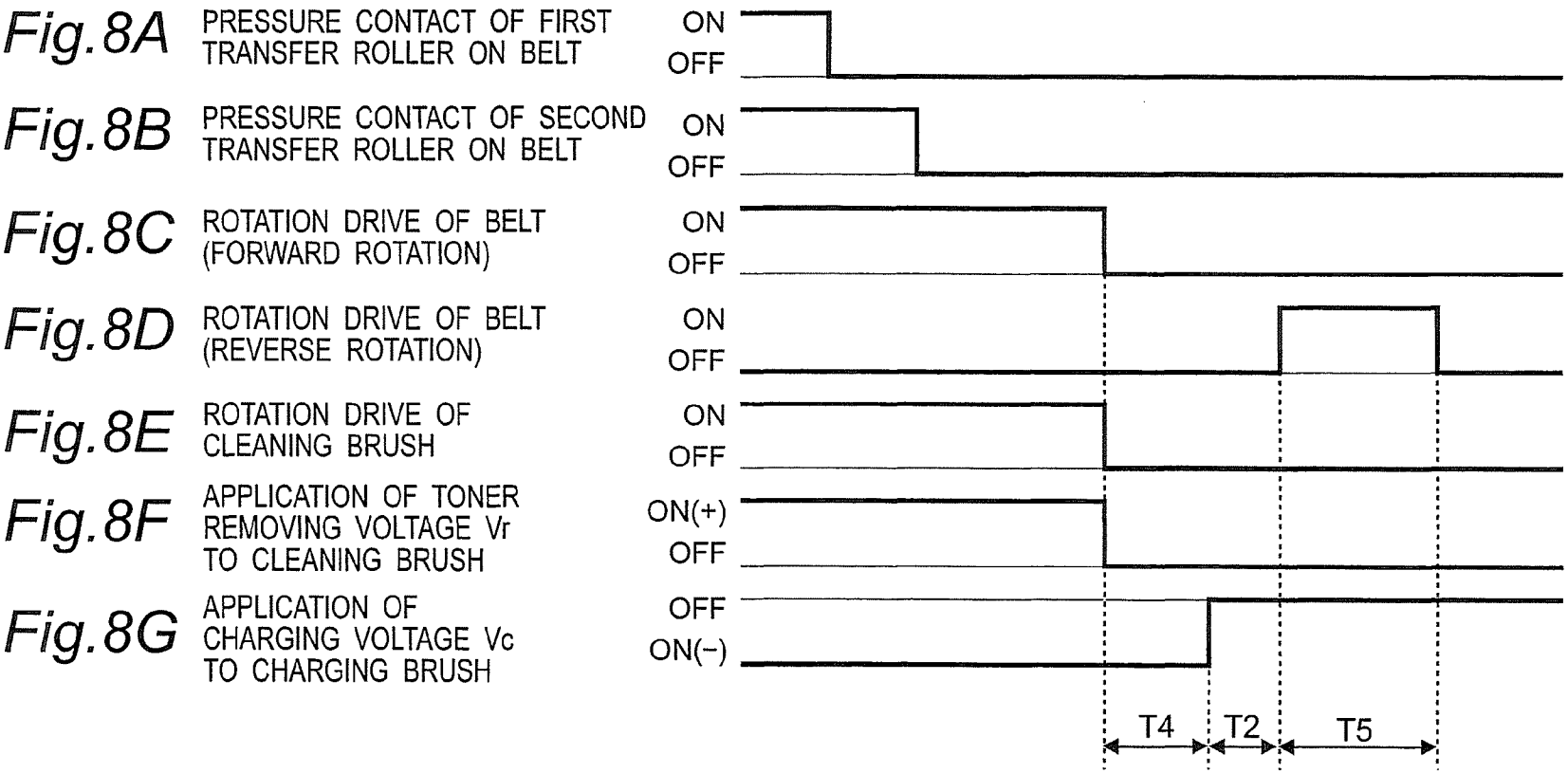
Fig.8A
PRESSURE CONTACT OF FIRST TRANSFER ROLLER ON BELT
ON
OFF
Fig.8B
PRESSURE CONTACT OF SECOND TRANSFER ROLLER ON BELT
ON
OFF
Fig.8C
ROTATION DRIVE OF BELT (FORWARD ROTATION)
ON
OFF
Fig.8D
ROTATION DRIVE OF BELT (REVERSE ROTATION)
ON
OFF
Fig.8E
ROTATION DRIVE OF CLEANING BRUSH
ON
OFF
Fig.8F
APPLICATION OF TONER REMOVING VOLTAGE Vr TO CLEANING BRUSH
ON(+)
OFF
Fig.8G
APPLICATION OF CHARGING VOLTAGE Vc TO CHARGING BRUSH
OFF
ON(−)
T4
T2
T5

Fig. 11A PRESSURE CONTACT OF FIRST TRANSFER ROLLER ON BELT
ON
OFF
Fig. 11B PRESSURE CONTACT OF SECOND TRANSFER ROLLER ON BELT
ON
OFF
Fig. 11C ROTATION DRIVE OF BELT
ON
OFF
Fig. 11D ROTATION DRIVE OF CLEANING BRUSH
ON
OFF
Fig. 11E APPLICATION OF TONER REMOVING VOLTAGE Vr TO CLEANING BRUSH
ON(+)
OFF
ON(−)
Fig. 11F APPLICATION OF CHARGING VOLTAGE Vc TO CHARGING BRUSH
OFF
ON(−)
T1
T6
T2
T3

IMAGE FORMING AND TONER CLEANING APPARATUS AND METHOD

BACKGROUND OF THE INVENTION

1. Field of the Invention

The present invention relates to an electrophotographic image forming apparatus and an electrophotographic image forming method. In particular, the present invention relates to an image forming apparatus such as a copying machine, a printer, a facsimile, and a multi-function peripheral with functions of such devices in combination and a method of forming images using the image forming apparatus.

2. Description of the Related Art

An electrophotographic, monochrome image forming apparatus forms single color toner images on a photosensitive member. The toner images are transferred onto a sheet material passing through a nipping region defined between the photosensitive member and a transfer roller. Not all the toner particles are transferred onto the sheet material and a part of the toner particles remains on the photosensitive member without being transferred. In order to remove the residual toner particles from the photosensitive member, a method is proposed in which a cleaning member is provided in contact with the surface of the photosensitive member to remove the toner particles therefrom.

A variety of full color image forming apparatuses have been proposed so far. Among other things, one of the proposed electrophotographic, full color image forming apparatus is designed to transfer the toner images on the photosensitive member onto an intermediate transfer belt passing through a nipping region defined between the photosensitive member and a first transfer roller. The toner images are then transferred onto the sheet material passing through a second nipping region defined between the intermediate transfer belt and a second transfer roller. The residual toner particles on the intermediate transfer belt are removed by a cleaning member provided in contact with the photosensitive member.

Conventionally, the cleaning member for removing residual toner particles from the photosensitive member and the intermediate transfer belt is made of rubber blade or rotatable brush. For example, JP 2004-310060 A discloses a cleaning device with a cleaning member made of rotatable brush for the cleaning of the intermediate transfer belt.

As shown in FIG. 13, the cleaning device disclosed in JP 2004-310060 A includes a cleaning brush 142 provided in contact with the intermediate transfer belt 130, a charging brush 174 also provided in contact with the intermediate transfer belt 130 on the upstream side from the cleaning brush 142 with reference to the moving direction of the intermediate transfer belt (counterclockwise direction in the drawing), a collecting roller 177 provided in contact with the cleaning brush 142, and a scraper 178 provided in contact with the collecting roller 177. A power supply 184 is connected to the scraper 178, and the charging brush 174 is grounded. With the arrangement, when the power supply 184 is turned on, electric current flows from the power supply 184 to the scraper 178 through the scraper 178, the collecting roller 177, the cleaning brush 142, the intermediate transfer belt 130, and the charging brush 174. This results in that most of the toner particles on the intermediate transfer belt 177 are electrically charged into a negative polarity. The negatively charged toner particles are then transported by the rotation of the belt 130 in the contact region of the cleaning brush 142 and the intermediate belt 130 where they are electrically attracted by the cleaning brush 142 and then removed from the intermediate transfer belt 177.

According to this arrangement, the toner particles not negatively charged between the intermediate transfer belt 130 and the charging brush 174 may be electrostatically and/or mechanically collected by and accumulated between the bristles of the brush 174. The accumulated toner particles may be transferred from the brush 174 due to, for example, vibrations caused by the engagements of the bristles with the rotating belt 130 and then adhere to the outer periphery of the belt 130. The toner particles adhered on the imaging region of the intermediate transfer belt can be transferred at the second transfer region onto the sheet material to deteriorate the resultant image quality. On the other hand, the toner particles adhered on the non-imaging region of the intermediate transfer belt can be transferred to the second transfer belt, which in turn is transferred onto the opposite surface of the sheet material.

In order to prevent the toner particles from being transferred onto the sheet material, before forming toner images, the intermediate transfer belt 130 may be circulated a full turn to transport the toner particles on the intermediate transfer belt into the contact region between the intermediate transfer belt 130 and the charging brush 174 where the toner particles are electrically charged and then removed by the subsequent contact with the cleaning brush, which disadvantageously delays the start of the image forming operation.

SUMMARY OF THE INVENTION

Accordingly, a purpose of the present invention is to provide an image forming apparatus and an image forming method capable of preventing the recording medium from being stained by the transfer of the toner particles transferred from the image bearing member and also capable of starting the image forming operation without delay.

To this end, an image forming apparatus of the present invention comprises an image bearing member, the image bearing member having an endless image bearing surface and supported for rotation;

a charging member made of a brush provided in contact with the image bearing surface to define a charging region; and a controller for controlling an image forming operation in which the toner image is provided to a recording medium; and a transfer operation in which the rotation of the image bearing member is halted and then toner particles accumulated in the brush are transferred onto the image bearing surface at the charging region.

BRIEF DESCRIPTION OF THE DRAWINGS

FIG. 8 is a time chart of control of various operations of the post-processing sequence according to the second embodiment;

DETAILED DESCRIPTION OF THE PREFERRED EMBODIMENTS

Figure 1:
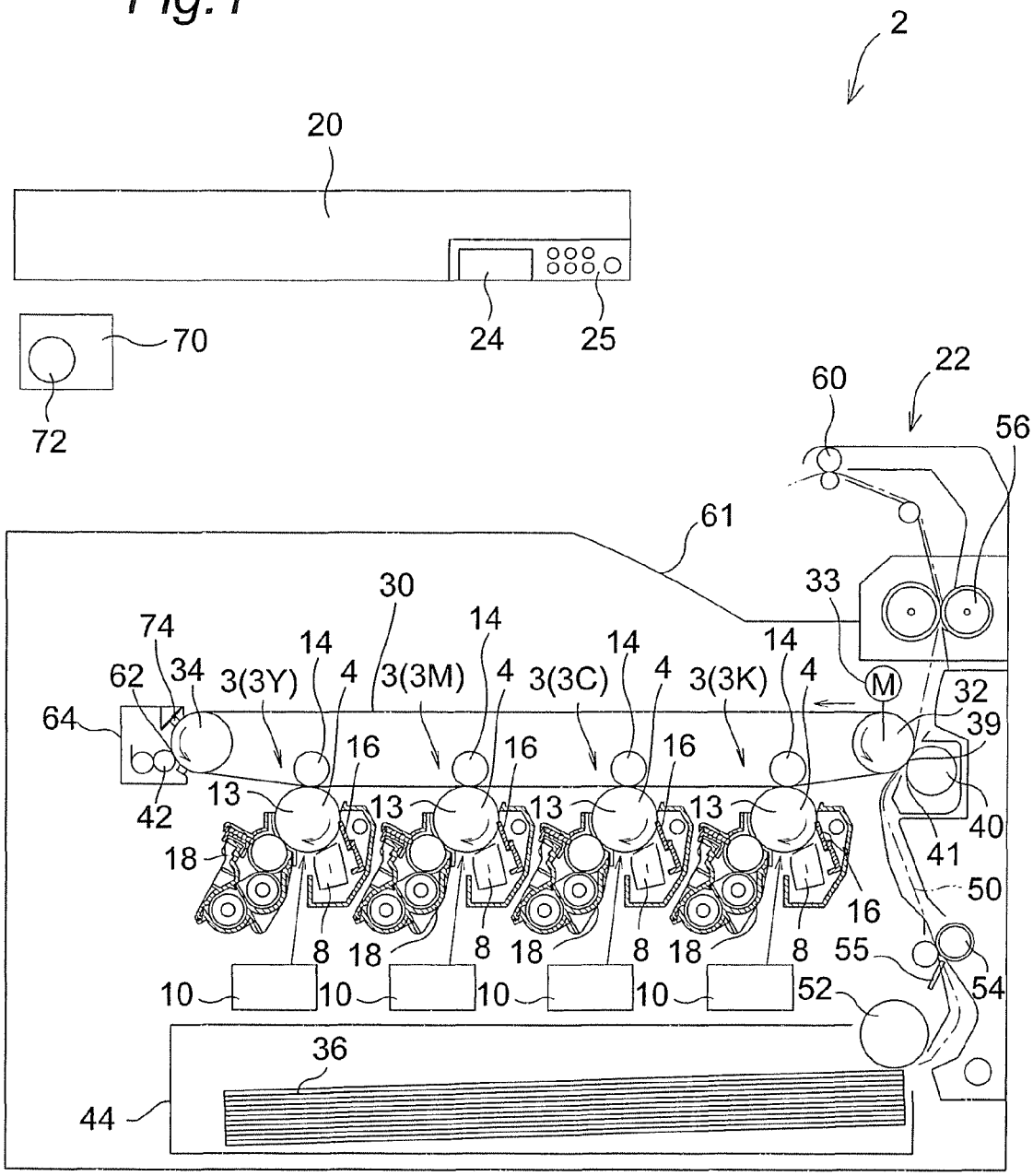
FIG. 1 is an elevational view showing a schematic configuration of an image forming apparatus according to the present invention.

Referring now to the drawings, several embodiments of the present invention will be described. In the following descriptions, terms indicating specific directions and positions (e.g., "up", "down", "left", "right" and other terms including any one of such terms) are used as necessary, however, the use of such terms intends to facilitate better understanding of the invention in connection with the drawings and therefore the scope of the present invention should not be limited by such terms.

First Embodiment

FIG. 1 schematically shows an image forming apparatus 2 according to a first embodiment of the present invention. The image forming apparatus 2 is an electrophotographic image forming apparatus such as a copying machine, a printer, a facsimile, or a multifunction device with functions of such devices. Although various electrophotographic image forming apparatuses are currently available, the illustrated image forming apparatus is a so-called tandem type color image forming apparatus. The present invention may be applied not only to that image forming apparatus but also to a so-called four-cycle color image forming apparatus and a direct transfer color image forming apparatus in which the toner images on the electrostatic latent image bearing member are directly transferred onto the recording medium. In addition, the present invention is also applicable to the monochrome image forming apparatus with a single developing device.

The image forming apparatus 2 generally includes an image reading unit generally indicated by reference numeral 20 for reading a document image and a printing unit generally indicated by reference numeral 22 for printing the image. The image reading unit 20 is configured to perform a color separation of the document image into three color elements of red (R), green (G), and blue (B) by a well-known color separation technique and then generate image data of red (R), green (G), and blue (B).

The image forming apparatus may include a display device 24 for displaying various information relating to the printing and an operation panel 25 for allowing users to perform printing and various setting operations for printing.

Figure 2:
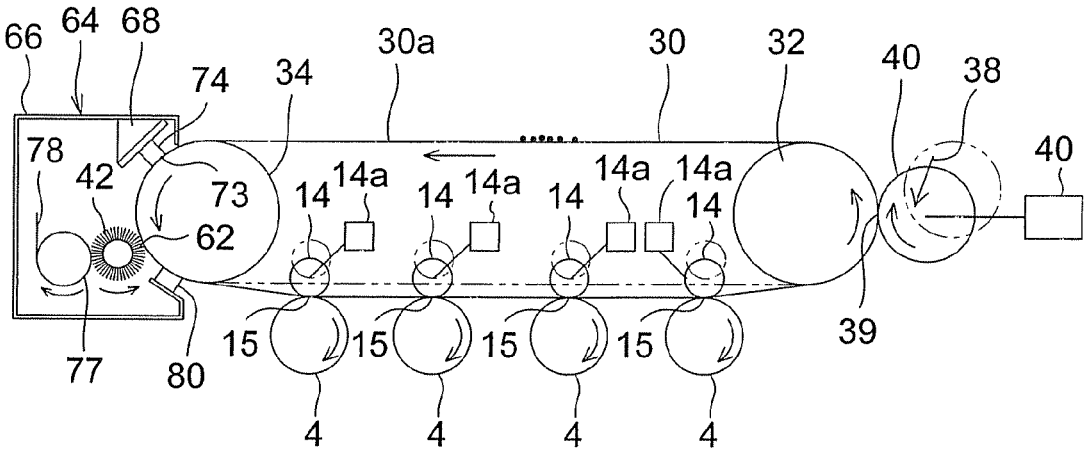
FIG. 2 is a schematic elevational view showing an intermediate transfer belt and members at the periphery thereof.
Figure 3:
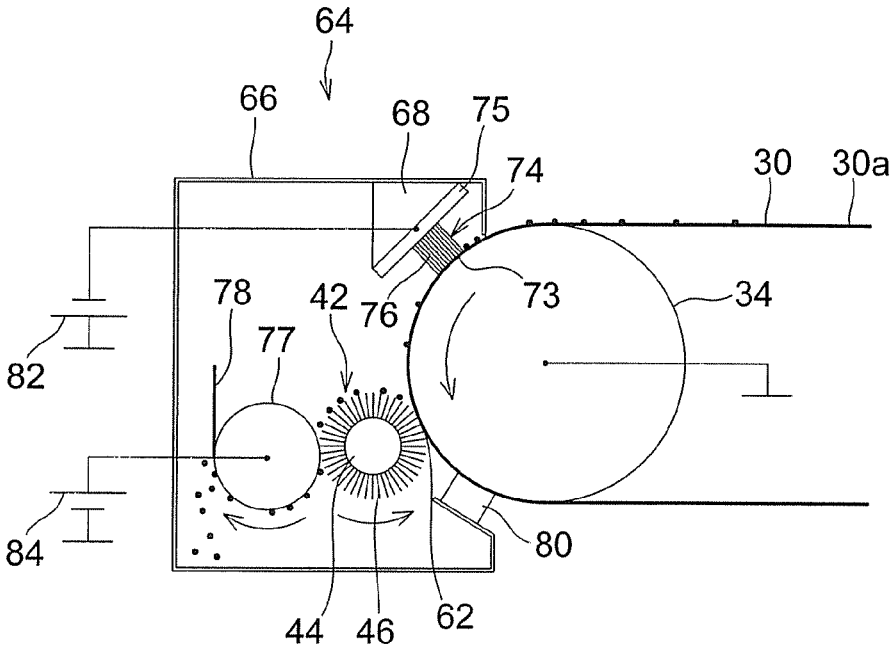
FIG. 3 is an elevational view showing a belt cleaning device.

The printing unit 22 has an image bearing member made of an endless intermediate transfer belt 30, having an endless image bearing peripheral surface 30*a* (FIGS. 2 and 3). Preferably, the belt 30 is made of a suitable material with an elevated transferring performance such as polyimide. More preferably, the belt 30 has a thickness of equal to or larger than 50 μm and equal to or less than 150 μm.

The belt 30 is entrained around a pair of rollers 32, 34 positioned on the left and right sides in the drawing. The right roller 32 is a drive roller drivingly coupled to a motor 33, so that the rotation of the motor is transmitted to the drive roller 32, which causes rotations of the belt 30 and the left roller 34 contacting the belt 30, in the counterclockwise direction.

Preferably, the drive roller 32 has an outer diameter of equal to or larger than 12 mm and equal to or less than 30 mm to minimize the image forming apparatus. Also preferably, the peripheral surface of the drive roller 32 is made of material having a large friction coefficient such as rubber or urethane to attain an enlarged frictional force between the belt 30 and the roller 32 and thereby a reliable transmission of the drive force to the belt 30.

Preferably, a suitable tensile force is introduced to the belt 30 by the rollers 32, 34 to ensure a sufficient frictional force between the drive roller 32 and the belt 30. Preferably, the tensile force is adjusted to equal to or greater than 15N and equal to or less than 50N, for example.

A second transfer member made of transfer roller 40 is provided in a second transfer station 38 adjacent the belt portion supported by the right drive roller 32 so as to nip the recording medium 36 with the belt 30. As shown in FIG. 2, the transfer roller 40 is supported by a mechanism 41 so that it can be moved between a contact position (indicated by solid line) where the roller 40 contacts the outer peripheral surface of the belt 30 to form a nipping region or a second transfer region 39 and a non-contact position (indicated by imaginary line) where the roller 40 is spaced away from the outer peripheral surface of the belt 30. Preferably, the transfer roller 40 is made of an ion conductive roller or an electron conductive roller.

A cleaning device generally indicated by reference numeral 64 for cleaning the belt 30 is provided outside the belt portion supported by the left roller 34, which will be described in detail later.

Referring back to FIG. 1, the image forming apparatus 2 has four first transfer stations 13 where four imaging units 3 (3Y, 3M, 3C, 3K) are mounted in this order below and along the lower belt portion running from the left roller 34 to the right roller 32 for forming toner images with developers of different colors, yellow (Y), magenta (M), cyan (C), and black (K).

Each of four imaging units 3 has an electrostatic latent image bearing member made of cylindrical photosensitive member 4 mounted for rotation in the clockwise direction. A charger 8, an exposure device 10, a developing device 18, a first transfer roller 14, and a cleaning member 16 are positioned around the photosensitive member 4 in this order with respect to the rotational direction thereof.

The first transfer roller 14 is arranged within a space defined by the endless belt 30. As shown in FIG. 2, the transfer roller 14 is supported by a support mechanism 14*a* for moving between a position where it is forced to the corresponding photosensitive member 4 through the belt 30 and a position where it is spaced away from the photosensitive member 4 and the belt 30. A high voltage power supply (not shown) is connected to the transfer roller 14 so that a first transfer voltage is applied to the transfer roller 14 from the power supply during the formation of the toner images.

Referring again to FIG. 1, the printing unit 22 includes a control unit 70 for controlling various operations such as image forming operation. The printing unit 22 further includes a paper cassette 44 removably arranged in the lower part thereof so that, when printing, the recording mediums 36 stacked in the paper supply cassette 44 are fed out one by one to a transport passage 50 by the rotation of a feed roller 52 mounted on the paper cassette 44.

A registration roller 54, for transporting the paper 36 to the second transfer region 39 at a predetermined timing, is arranged adjacent the feed roller 52. A paper detector 55 for detecting the front edge of the paper 36 being transported is arranged adjacent the registration roller 54.

The transport passage 50 extends from the paper cassette 44 to a paper discharge tray 61 mounted at the upper portion of the printing unit 22 through the nipping regions defined by paired registration rollers 54, the second transfer roller 40 and the belt 30, paired fusing rollers 56, and discharging rollers 60.

Discussions will be made to a color image forming operation. In this operation, the image reading unit 20 reads the document image to generate image data of respective colors of red (R), green (G), and blue (B). The image data is transmitted to the control unit 70 where it is processed and transformed into color image data of yellow (Y), magenta (M), cyan (C), and black (K). The processed image data of yellow, magenta, cyan, and black colors is stored in an image memory 72 in the control unit 70. The image date is corrected to remove possible misregistration of the images and then converted into drive signals for causing light emission of a light source (not shown) in the exposure device 10.

Each photosensitive member 4 is rotated in the clockwise direction, during which its peripheral surface is electrically charged by the charger 8. The charged peripheral surface is exposed to light emitted from the exposure device 10 in response to the drive signal from the control unit 70, so that a corresponding electrostatic latent image is formed on the peripheral surface. The electrostatic image is then visualized by a developing material of toner particles supplied from the associated developing device 8. The toner images of respective colors of yellow, magenta, cyan, and black on respective photosensitive members 4 are transported into respective first transfer regions 15 where they are transferred onto the belt 30 in this order and superimposed thereon.

Toner particles not transferred from each image bearing member 4 to the belt 30 are transported by the rotation of the image bearing member 4 into the contact region between the photosensitive member 4 and the cleaning member 16 where it is scraped off from the peripheral surface of the photosensitive member 4. The superimposed four toner images are transported by the belt 30 into the second transfer region 39.

The recording medium 36 accommodated in the paper cassette 44 is fed out by the rotation of the supply roller 52 into the nipping region of the paired registration rollers 54 and then into the second transfer region 39 while taking a suitable timing with the toner images being transported by the belt 30 into the second transfer region 39.

Toner images are transferred onto the incremental portions of the recording medium 36 passing the second transfer region 39. The recording medium 36 is further transported to the nipping region of the paired fusing rollers 56 where the toner images are fixed to the recording medium 36 and finally transported by paired the discharge rollers 60 onto the discharge tray 61.

The toner particles without being transferred onto the recording medium and remaining on the peripheral surface of the belt 30 are removed therefrom by the cleaning device 64 which will be described below. As shown in FIG. 3, the cleaning device 64 has a charging brush 74 for electrically charging the toner particles on the peripheral surface of the belt 30 with a predetermined electric charge of negative polarity in this embodiment, a cleaning member made of brush 42 in the form of roll for removing the toner particles from the periphery of the belt 30, a collecting roller 77 for collecting toner particles from the cleaning brush 42, a scraper 78 for scraping off toner particles from the collecting roller 77, and a housing 66 for housing those members 74, 42, 77, and 78 therein.

The charging brush 74 and the cleaning brush 42 are mounted in contact with respective outer peripheral surface portions of the belt 30 supported by the roller 34. The charging brush 74 has a base 75 in the form of plate, for example, and a number of bristles 76 planted in the base 75 so that distal ends thereof are in contact with the outer peripheral surface of the belt 30 to define a contact region or charging region 73 therebetween. The base 75 is securely mounted to a support 68 projected from and fixed to the inner surface of the housing wall. The base 75 is made of electrically conductive material such as metal. The bristles 74 are also made of electrically conductive material such as electrically conductive resin.

The cleaning brush 42 in the form of roll is positioned on the downstream of the charging brush 74 with respect to the rotational direction of the belt 30 in the image forming operation. Preferably, the cleaning brush 42 is designed to rotate in a direction so that the bristles 76 travel in a direction (i.e., counterclockwise direction) opposite to the moving direction of the belt 30 at the contact region 62 between the belt 30 and the bristles 42. The contact region 62 of the brush 42 and the belt 30 defines a collecting region for collecting the untransferred toner particles from the belt 30. In this embodiment, the cleaning brush 42 has a solid or hollow cylindrical central portion 44 and a number of bristles 46 planted in the entire outer periphery of the central portion 44 and extending radially outwardly from the central portion 44. Preferably, the central portion 44 is made of metal such as iron, aluminum, and stainless and the bristles 76 are made of electrically conductive material such as conductive resin.

The collecting roller 77 is positioned in contact with the cleaning brush 42. The rotational direction of the collecting roller 77 is so determined that the peripheral portions of the cleaning brush 42 and the collecting roller 77 move in the same direction in the contact region thereof. In this embodiment, the collecting roller 77 is mounted to rotate in the clockwise direction. The collecting roller 77 is made of electrically conductive material such as iron, aluminum, and stainless.

The scraper 78 is made of elongate plate and is positioned so that it extends substantially parallel to the axial direction of the collecting roller 77 with its distal end in contact with the outer peripheral surface of the collecting roller 77. Although not limited thereto, a suitable metal plate such as stainless plate is used for the scraper 78.

Preferably, a filming protection and sealing member 80 is filled in a gap defined on the downstream side of the cleaning brush 42 and between the belt and the opposing housing portion to prevent generations of film of toner, i.e., filming, and toner scattering, which would otherwise be caused by toner particles passing through the contact region between the belt 30 and the cleaning brush 42.

A first voltage apply device made of power source 82 is connected to the base 75 of the brush roller 74 and a second voltage apply device made of power source 84 is connected to the collecting roller 77. The belt 34 to which the charging brush 74 and the cleaning brush 42 are forced is connected to the ground. In the case that the scraper 78 is made of electrically conductive material, it may be connected to the power source 84.

The power source 82 is designed to apply a charging voltage Vc to the charging brush 74 in order to electrically charge the toner particles being transported by the belt 30 at the contact region 73 between the belt 30 and the charging brush 74. Preferably, the voltage Vc is controlled under the constant current between −100 μA and −10 μA. The charging voltage Vc has the same polarity (negative polarity in the embodiment) as the properly charged toner particles and is set to be about −5,000 volts to −500 volts, for example.

The power source 84 is designed to apply a cleaning voltage Vr to the collecting roller 77 so as to flow a certain electric current from the power source 84 through the collecting roller 77 and the cleaning brush 42, causing the toner particles on the belt 30 to be electrically collected from the belt 30 to the cleaning brush 42. This results in a voltage gap between the collecting roller 77 and the cleaning brush 42 so that the voltage of the collecting roller 77 is higher than that of the cleaning brush 42. The cleaning voltage Vr has a different polarity (positive polarity in the embodiment) than the properly charged toner particles and is set to be about 500 volts to 5,000 volts, for example.

Discussions will be made to the operation in which the untransferred toner particles are collected from the outer peripheral surface of the belt 30 by the use of the cleaning device 64. In this discussion, the toner particles are normally charge with negative polarity and the cleaning voltage Vr has positive polarity.

As seen from FIG. 2, during a time period from the formation of the toner images to the second transfer thereof onto the recording medium 36, the untransferred toner particles on the belt 30 are transported into the downstream side of the second transfer region 39 with the movement of the belt 30. The properly charged toner particles have a negative charge. The untransferred toner particles consist essentially of the one with insufficient charge and the one with positive charge in different amounts per toner particle.

As shown in FIG. 3, since the charging brush 74 is applied with the negative voltage Vc, a large part of the untransferred toner particles transported by the rotation of the belt 30 into the contact region 73 with charging brush 74 are negatively charged by the contact with the charging brush 74. The negatively charged untransferred toner particles are further transported into the downstream side by the rotation of the belt 30.

In the contact region 73 of the charging brush 74, the positively charged untransferred toner particles may be electrically attracted to the bristles of the charging brush 74 and the insufficiently charge untransferred toner particles may be caught by the mechanical contact with the bristles of the charging brush 74. The toner particles collected by the charging brush 74 are accumulated within the charging brush 74.

The toner particles negatively charged by the charging brush 74 is transported by the rotation of the belt 30 into the next contact region 62 between the belt 30 and the cleaning brush 42 where they are electrically attracted and collected by the cleaning brush 42 with the positive voltage Vr applied thereto.

The toner particles collected by the cleaning brush 42 is then transported by the rotation of the brush 42 into the contact region between the brush 42 and the collecting roller 77 where, since the voltage of the collecting roller 77 is higher than that of the brush 42, the toner particles are electrically attracted and collected onto the collecting roller 77.

The toner particles collected by the collecting roller 77 are then transported by the rotation of the roller 77 into the contact region between the roller 77 and the scraper 78 where they are mechanically collected by the scraper 78.

The untransferred toner collecting operations by the cleaning device 64 described above causes an accumulation of the toner particles within the charging brush 78. The accumulated toner particles within the charging brush 74 may cause in the subsequent image forming operations that the accumulated toner particles be transferred onto the belt 30 due to vibrations generated by the repetitional and frictional contacts of the bristles of the brush 74 with the rotating belt 30. As described above, the most of the accumulated toner particles within the charging brush 74 have less charge and/or positive charge, so that the toner particles transferred from the charging brush 74 onto the belt 30 are unlikely to be electrically attracted by the bristles of the cleaning brush 42 from the belt 30 and transported by the belt into the second transfer region 39 where they would be transferred directly or by way of the second transfer roller 40 onto the recording medium 36.

In order to eliminate such drawbacks, according to the present invention the controller 70 causes the charging brush 74 to transfer the accumulated toner particles from the charging brush 74 onto the belt 30 at the final stage of the image formation, in particular, in the post post-process sequence.

The transfer operation is accompanied by an additional rotational movement of the belt performed after the completion of the rotational movement of the belt 30 for the image formation.

The additional rotational movement of the belt 30 is performed after turning off the application of the negative voltage Vc to the charging brush 74. This eliminates the electrical attraction between the positively charged toner particles within the brush 74 and the bristles of the brush 74, causing the accumulated toner particles to be transferred easily from the brush 74.

In the transfer operation, the second transfer roller 40 is maintained away from the belt 30. This prevents the transferred toner particles from being transferred onto the second transfer roller 40 when passing through the opposing region between the belt 30 and the second transfer roller 40 with the rotational movement of the belt 30.

The additional rotational movement of the belt 30 is so limited that the toner particles transferred from the brush 74 onto the belt at the contact region 73 between the belt 30 and the brush 74 are transported and maintained in a region extending from the second transfer region 39 to the contacting region 73 when the rotation of the belt 30 is halted, which allows that the transferred toner particles on the belt 30 are further transported by the rotational movement of the belt 30 immediately after the starting of the subsequent image forming operation into the contact region 73 where they are negatively charged by the charging brush 74 and then into the contact region 62 where they are collected by the cleaning brush 42, prohibiting the untransferred toner particles from being transferred from the belt 30 to the recording medium 36 during the subsequent image forming operation.

Figure 12:
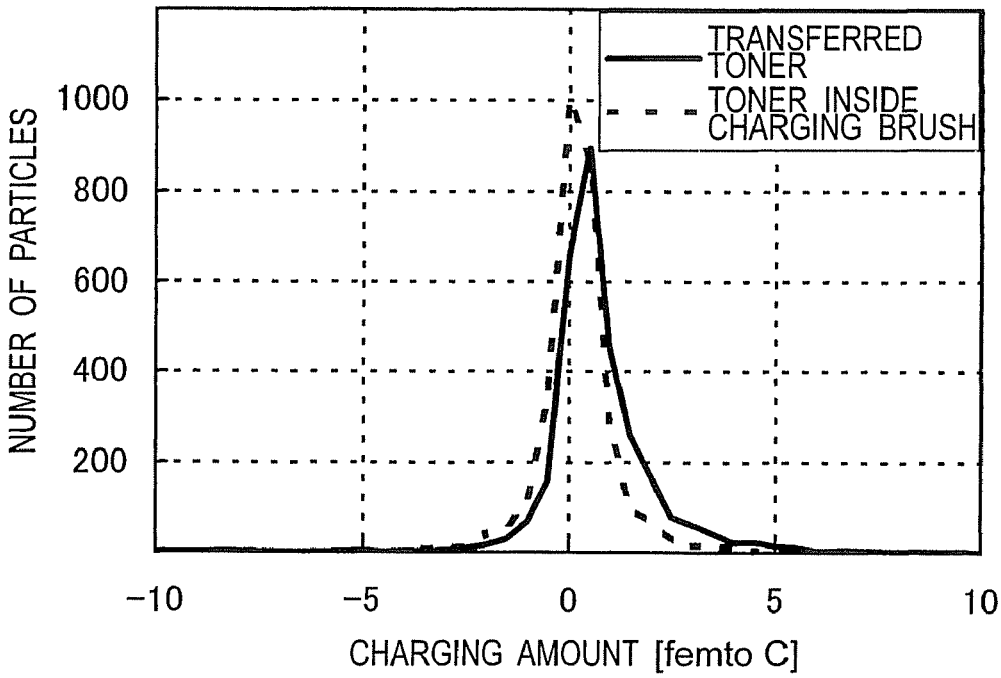
FIG. 12 is a graph showing distribution of charging amount of toner inside a charging brush and of toner transferred from the inside of the charging brush to the surface of a belt.
Figure 13:
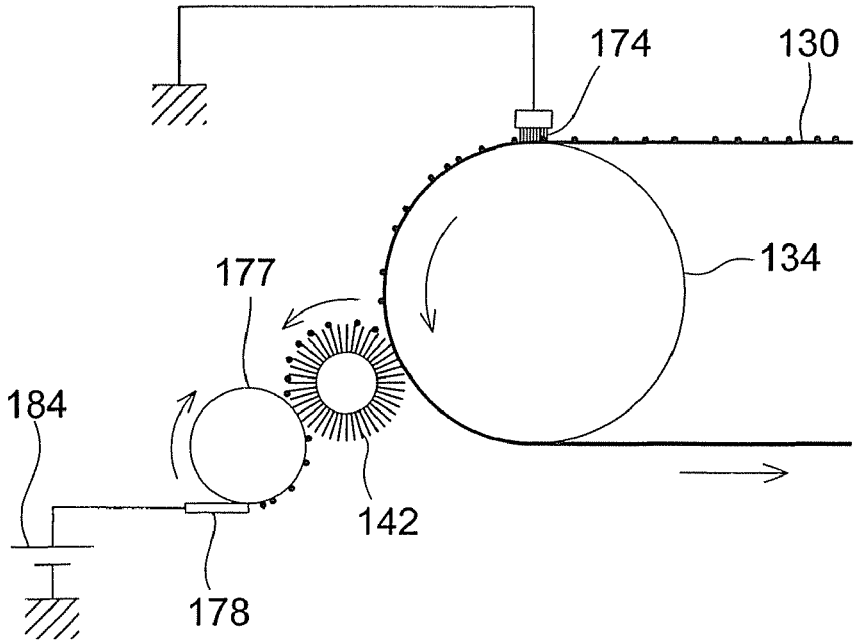
FIG. 13 is a view showing one example of a configuration of a conventional intermediate transfer belt cleaning device.

FIG. 12 shows a relationship between an amount of electric charge of the toner particles accumulated within the charging brush 74 and the number of toner particles transferred from the brush 74 to the belt 30. The amount of electric charge was measured for each of 3,000 toner particles using the analyzer commercially available from Hosokawa Micron Co. under the tradename "E-SPART". The graph shows that the toner particles accumulated within and transferred from the brush 74 have various amount of electric charges with positive and negative polarities. Also, the total amount of electric charge of the accumulated toner particles is substantially zero. Further, the total amount of electric charge of the transferred toner particles is likely to have a slight positive polarity. Furthermore, each of the accumulated and transferred toner includes slightly charged particles.

Referring to the flowcharts, an embodiment of the transfer operation will be described in detail.

Main Routine

Figure 4:
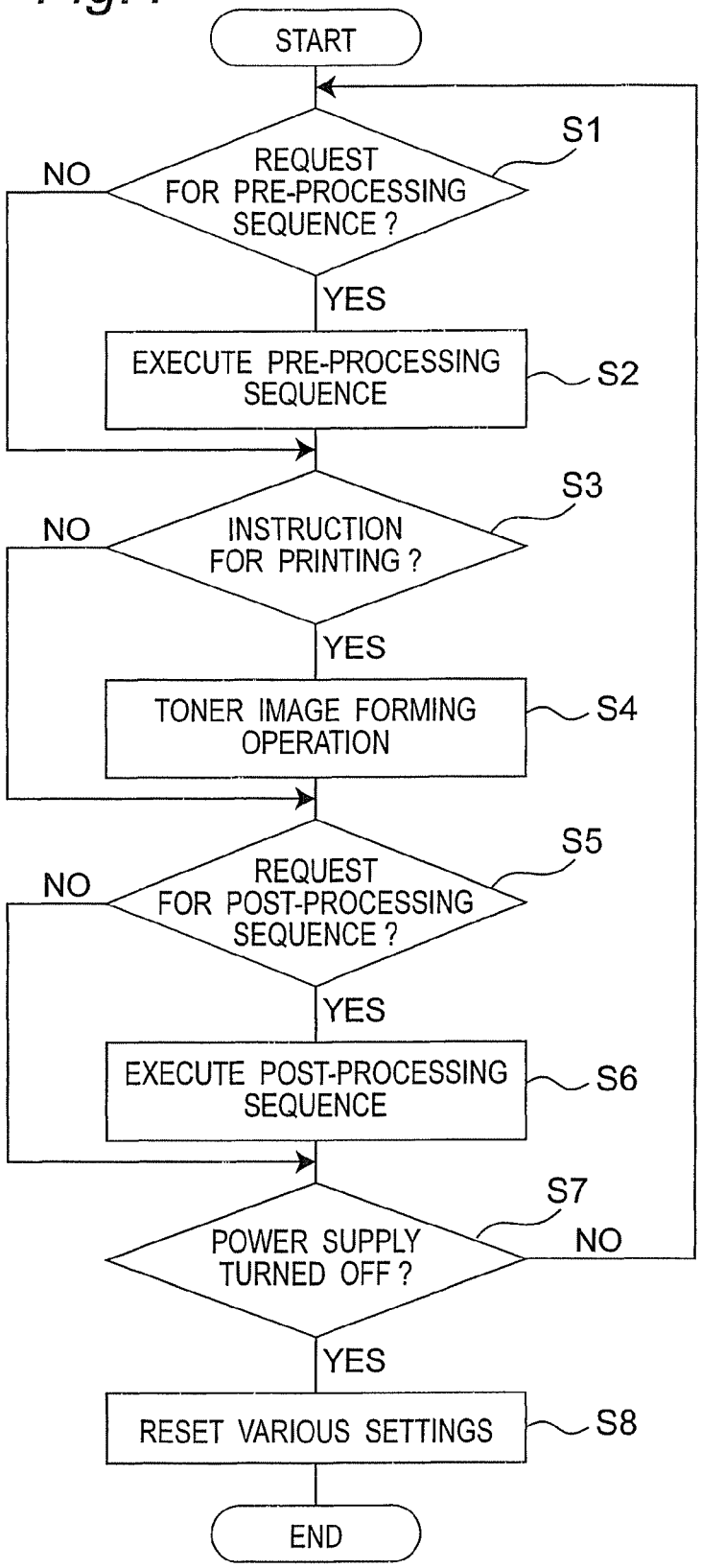
FIG. 4 is a flowchart showing a program flow of process of the main routine.

As shown in FIG. 4, when the main switch of the image forming apparatus 2 is turned on, the main routine is initiated. In this routine, it is determined at step 1 whether a pre-processing operation is required.

If it is determined at step 1 that the pre-processing operation is required, this operation is performed at the next step 2. Otherwise, the program proceeds to step 3.

At step 3 it is determined whether the printing is required. If yes, the toner-image forming operations including development and first and second transfer operations are performed at step 4. Otherwise, the program proceeds to step 5.

It is then determined at step 5 whether the post-processing operations is required. If yes, the post-processing operation is performed at the next step 6. Otherwise, the program proceeds to step 7.

If it is determined at step 7 that the image forming apparatus is disconnected from the power source. If yes, various operational settings in the controller 70 are reset at step S8 and then the program completes the main routine. Otherwise, the program returns to step S1.

Post-Processing Operation

The post-processing operation is performed after the toner-image forming operations including development and first and second transfer operations. When entered the post-processing operation, as shown in FIG. 6, the first and second transfer rollers, 14 and 40, are forced to the belt 30 while the belt 30 and the cleaning brush 42 are rotating. Also, the charging brush 74 is applied with the charging voltage Vc, and the cleaning brush 42 is applied with the toner cleaning voltage Vr.

Figure 5:
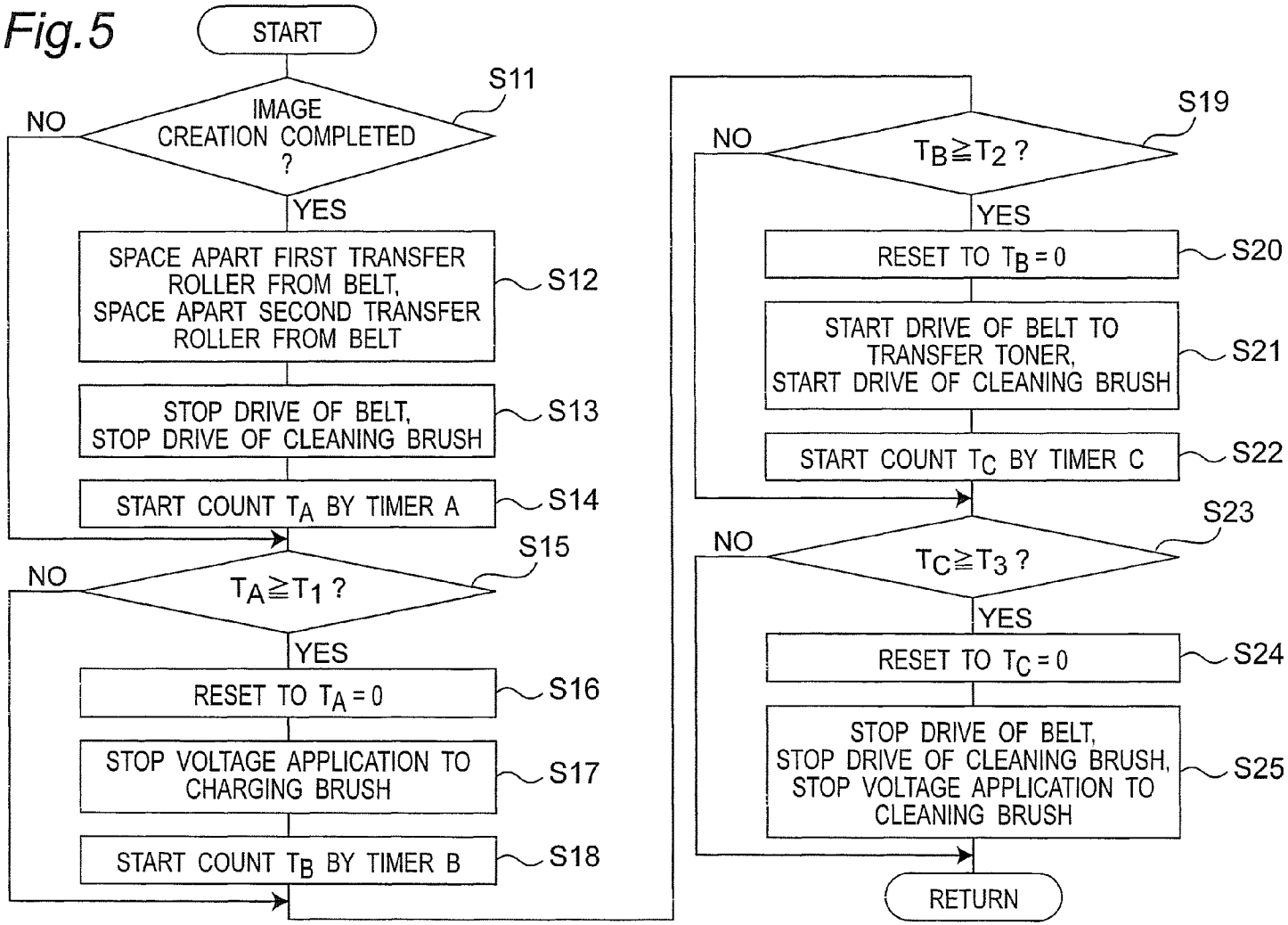
FIG. 5 is a flowchart showing a program flow of process of a post-processing sequence according to a first embodiment.

As shown in FIG. 5, in the post-processing operation, in particular at step 11, it is determined whether the image formation of the images to be printed has been completed. If yes, the first and second transfer rollers, 14 and 40, are spaced away from the belt 30 at step 12 (see FIGS. 6A and 6B) and then the program proceeds to step 13. Otherwise, the program proceeds to step 15.

Figures 6A, 6B, 6C, 6D, 6E, 6F:
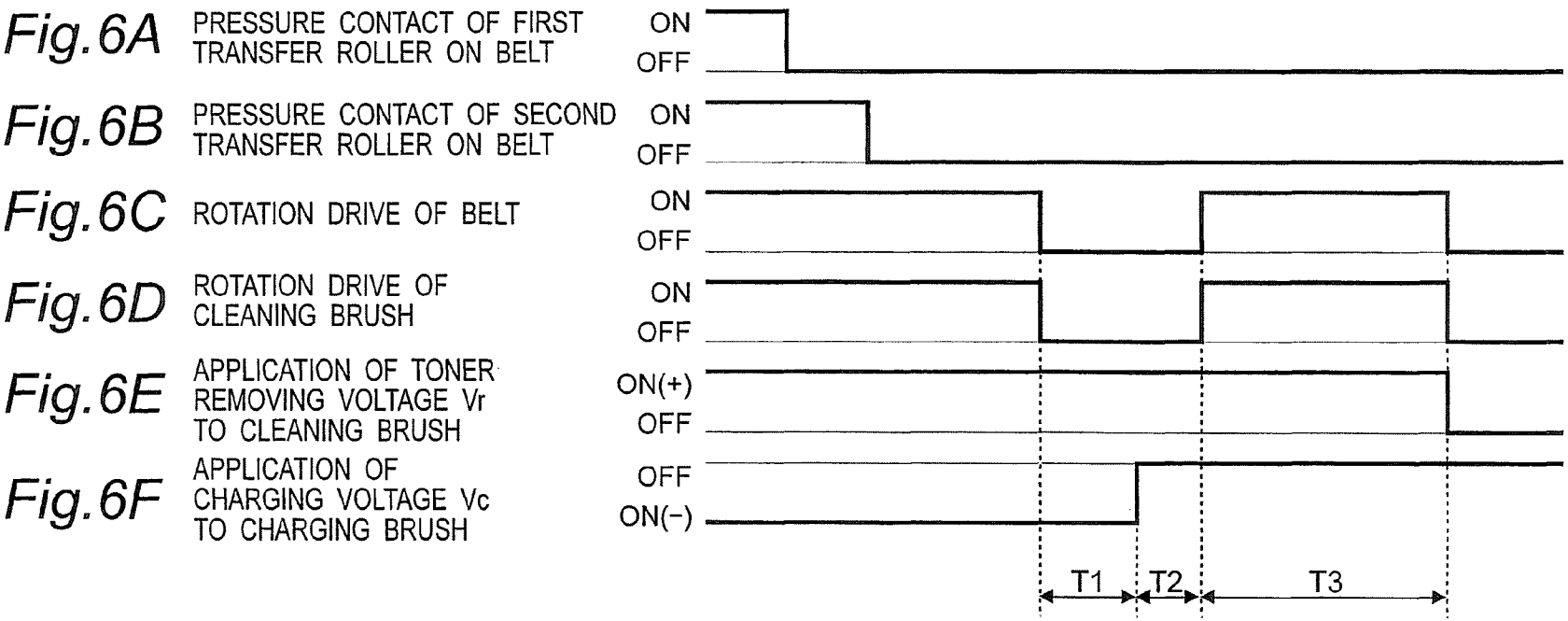
FIG. 6 is a time chart of control of various operations of the post-processing sequence according to the first embodiment.

At step 13, the rotational movement of the belt 30 and the cleaning brush 74 are halted (see FIGS. 6C and 6D). Subsequently, a counter $T_A$ of the timer A starts counting at step 14.

If it is determined at step 15 that the counter $T_A$ counts up a predetermined time T1, the counter $T_A$ is reset and the program proceeds to step 17. Otherwise, the program proceeds to step 19.

At step 17, the application of the charging voltage Vc to the charging brush 74 is turned off (see FIG. 6) and then the program proceeds to step 18. When the negative charging voltage Vc is turned off, the electrical attraction between the toner particles within the charging brush 74 and the bristles of the brush 74 is eliminated. In addition, the voltage difference between the belt 30 and the charging brush 74 becomes substantially zero, which completely eliminates the electrical attraction between the positive toner particles and the charging brush 74.

A counter $T_B$ of the timer B starts counting at step 18 and then it is determined at step 19 whether the counter $T_B$ counts up a predetermined time $T_2$. The time $T_2$ is so determined that the charging voltage $V_c$ fully established within the time $T_2$ in response to the instruction from the controller 70. The time may be 0.1-2.0 seconds, for example.

If it is determined that the counter $T_B$ counts up the time $T_2$ at step 19, the counter $T_B$ is reset at the subsequent step 20 and then program proceeds to step 21. Otherwise, the program proceeds to step 23.

At step 21 the rotational movements of the belt 30 and the cleaning brush 42 are started for the transfer of the toner particles (see FIGS. 6C and 6D) and then the program proceeds to step 22. This results in the vibrations of the bristles of the brush 74, causing the toner particles accumulated within the charging brush 74 to be transferred onto the outer peripheral surface of the belt 30.

A counter $T_C$ of the timer C starts counting at step 22 and then it is determined at step 23 whether the counter $T_C$ counts up the time $T_3$. The time $T_3$ is determined so that the toner particles transferred from the brush onto the belt at the contact region between the belt 30 and the brush 74 are transported by the rotation of the belt 30 and, as a result, stay within a belt portion extending from the second transfer region 39 to the contacting region b73 when the rotation of the belt 30 is halted.

If it is determined at step 23 that the counter $T_c$ counts up the time $T_3$, the counter Tc is reset at step 24 and the program proceeds to step 25. Otherwise, the program returns to the main routine.

At step 25, the rotations of the belt 30 and the cleaning brush 42 are halted and the application of the voltage Vr is turned off (see FIGS. 6C, 6D, and 6E). Afterwards, the program returns to the main routine.

When the rotation of the belt 30 is halted, the portions of the belt 30 bearing the transferred toner particles stay between the opposing region of the belt 30 and the second transfer roller 40 and another opposing region of the belt 30 and the charging brush 74. The toner particles on the belt portions will be transported by the rotation of the belt 30 in the subsequent image forming operation into the contact region 73 between the belt 30 and the charging brush 74 where they are charged into the negative polarity by the charging brush 74. The charged toner particles are then transported into the subsequent contact region 62 between the belt 30 and the brush 42 where they are collected by the cleaning brush 42. This prohibits the transferred toner particles from being transferred from the belt 30 onto the recording medium 36 in the subsequent image forming operation.

Although the rotation of the cleaning brush 42 is halted simultaneously with the halt of the rotation of the belt 30 in the post-processing sequence, it may still be in the state of rotation when the belt 30 is halted.

Second Embodiment

According to the second embodiment of the present invention, the controller 70 drives the belt 30 in the opposite direction (i.e., clockwise direction in FIG. 2) in the toner transfer operation.

For this purpose, although not limited thereto, the motor 41 (see FIG. 1) of the drive mechanism uses a motor capable of being driven to rotate in opposite directions. Other structures and the resultant advantages are substantially the same as those described in the first embodiment.

Figure 7:
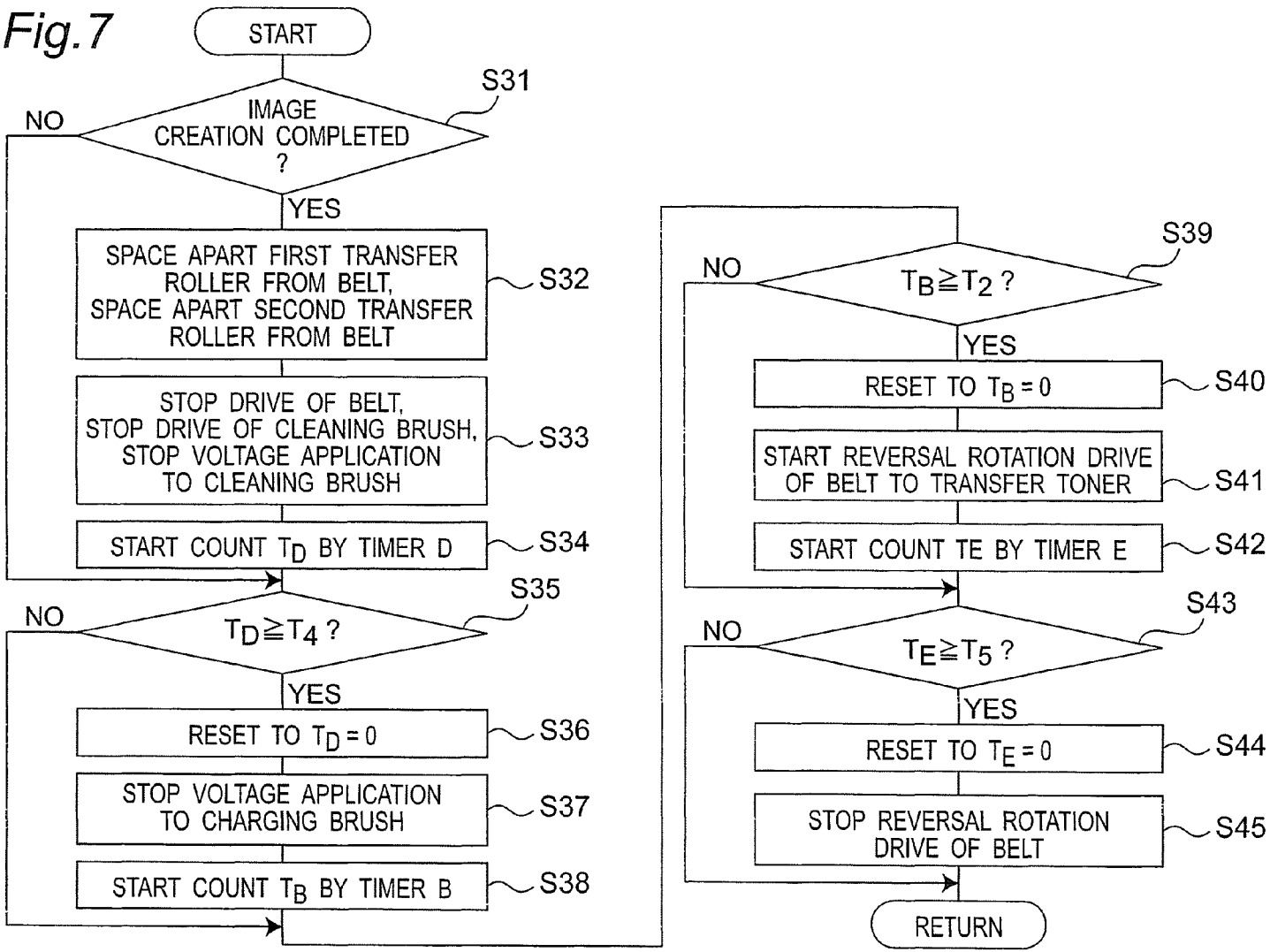
FIG. 7 is a flowchart showing the flow of process of a post-processing sequence according to a second embodiment.

Referring to FIGS. 7 and 8, the sequence flow of the post-processing operation will be described below. The operations in the main routine are the same as those in the first embodiment.

As shown in FIG. 7, when entered the post-processing operation, it is determined at step 31 whether the image forming operation has completed. If yes, the first and second transfer rollers, 14 and 40, are spaced away from the belt 30 at step 31 (see FIGS. 8A and 8B), and the program proceeds to step 33. Otherwise, the program proceeds to step 35.

The rotations of the belt 30 and the cleaning brush 42 are halted at step 33 and the application of the voltage Vr to the cleaning brush 42 is turned off (see FIGS. 8C, 8E, and 8F). A counter $T_D$ of the timer D then starts counting at step 34.

It is determined at step 35 whether the counter $T_D$ of the timer D counts up a predetermined time $T_4$. The time $T_4$ is determined so that times required for the belt 30 and brush 42 to halt completely after an issuance of an instruction from the controller 70 for halting the belt 30 and brush 42, respectively, and time required for the voltage Vr to be removed completely after an issuance of the instruction from the controller 70 for turning off the voltage, whichever is the longest. For example, the time is set to be equal to or more than 0.5 seconds and equal to or less than five seconds.

If it is determined at step 35 that the counter $T_D$ counts up the predetermined time $T_4$, the counter $T_D$ is reset to zero at step 36 and the program proceeds to step 37. Otherwise, the program proceeds to step 39.

At step 37, the voltage Vc to the charging brush 74 is turned off (see FIG. 8G), and the program proceeds to step 38. As described above at step 17 in the first embodiment, this causes that the electric attraction between the accumulated positive toner particles within the brush 74 and the bristles of the brush 74 is eliminated.

At step 38, the counter $T_B$ of the timer B starts counting. It is then determined at step 39 whether the counter counts up $T_B$. The time $T_2$ is determined to be the same as that in the first embodiment.

At step 39, if it is determined whether the counter $T_B$ counts up the predetermined time $T_2$, it is reset to zero at step 40 and the program proceeds to step 41. Otherwise, the program proceeds to step 43.

The belt 30 is driven to rotate for the transfer operation (see FIG. 8D) at step 41, and then the program proceeds to step 42. In the second embodiment, the belt 30 is rotated in another direction (clockwise direction in FIG. 2) which is opposite to that in the image forming operation. This allows that the toner particles accumulated within the charging brush 74 are transferred onto the outer peripheral surface of the belt 30, as described in the first embodiment.

The counter $T_E$ of the timer E stats counting at step 42, and then it is determined at step 43 whether the counter $T_E$ counts up the predetermined time $T_5$. The time $T_5$ is determined so that the toner particles transferred from the brush onto the belt at the contact region between the belt 30 and the brush 74 are transported by the rotation of the belt 30 and, as a result, stay within a belt portion extending from the second transfer region 39 to the contacting region 73 when the rotation of the belt 30 is halted. Since the rotational direction of the belt 30 is opposite to that in the image forming operation (i.e., clockwise direction in FIG. 2), which requires a reduced rotational displacement of the belt 30 than that in the first embodiment. This in turn means that the time $T_5$ is less than the corresponding time $T_3$ in the first embodiment and, as a result, the total time required for the post-operation is decreased.

If it is determined at step 43 that the counter $T_E$ counts up the predetermined time $T_5$, it is reset to zero at step 44. The program then proceeds to step 45. Otherwise, the program returns to the main routine.

At step 45, the rotation of the belt 30 is halted (see FIG. 8D). Then, the program proceeds to the main routine.

This causes that, as described in the first embodiment, the toner particles transferred on the belt 30 exist on the belt portion extending from the second transfer region between the belt and the second transfer roller to another contacting region between the belt and the charging brush 74 when the rotation of the belt 30 is halted. Therefore, when the subsequent image forming operation is started, the transferred toner particles are transported immediately by the rotation of the belt 30 into the contact region 73 of the belt 30 and the charging brush 74 where they are negatively charged by the charging brush 74. The negatively charged toner particles are then collected by the cleaning brush 74, which prevents the transferred toner particles from being transferred from the belt 30 to the recording medium 36.

Third Embodiment

The voltage Vr to be applied to the cleaning brush 42 for collecting toner particles from the belt 30 may take different levels in the image forming and the transfer operations, respectively. Specifically, the controller 70 controls the voltage Vr so that it has a first level with positive polarity in the image forming operation and a second level with negative polarity in the transfer operation.

Figure 9:
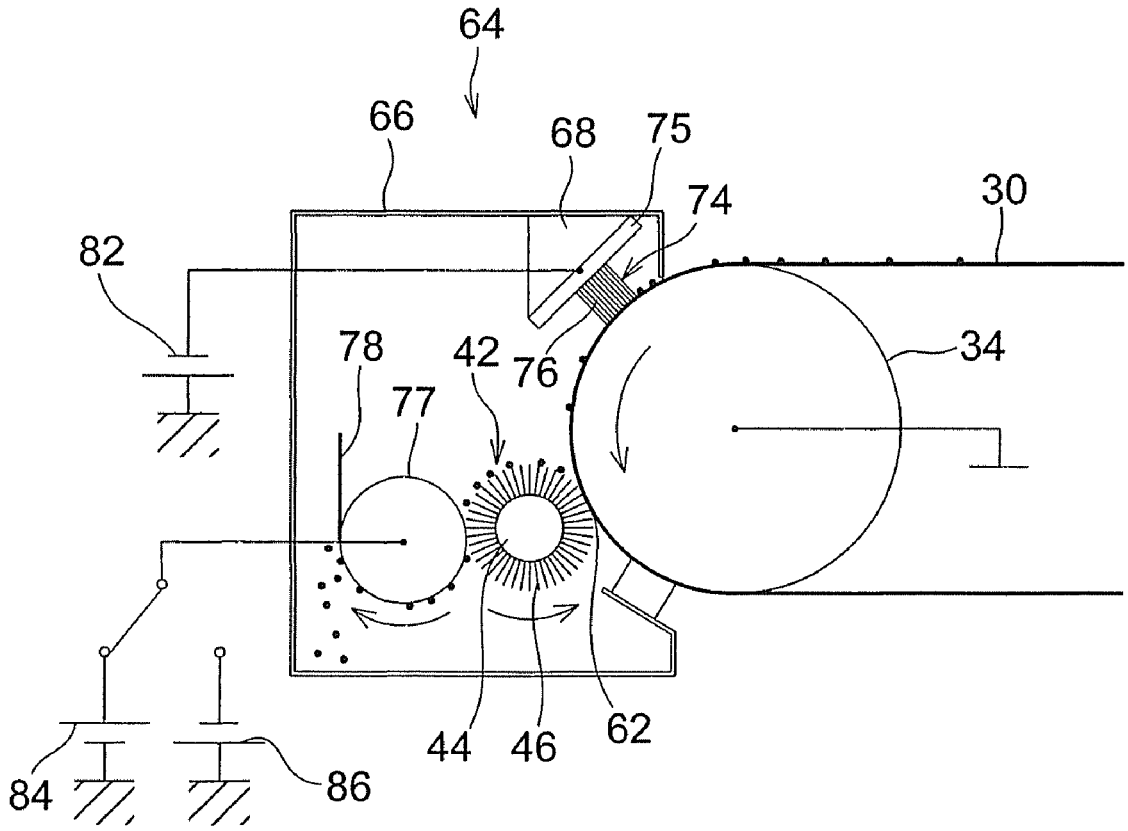
FIG. 9 is an enlarged view showing a belt cleaning device according to a third embodiment.

More specifically, as shown in FIG. 9, the image forming apparatus of this embodiment has a second voltage application means made of two voltage supplies 84 and 86 selectively connected to the collecting roller 77 on the basis of the instruction from the controller 70, so that the voltage Vr with the positive polarity is applied to the brush 42 when the voltage supply 84 is connected to the collecting roller 77 and the voltage Vr with the negative polarity is applied to the brush 42 when the voltage supply 86 is connected to the collecting roller 77.

The controller 70 connects the collecting roller 77 to the voltage supply 84 in the image forming operation to apply the voltage Vr with the positive polarity to the cleaning brush 42 and connects the collecting roller 77 to another voltage supply 84 in the transfer operation to apply the voltage Vr with the negative polarity to the cleaning brush 42.

This allows that the toner particles negatively charged by the brush 74 are collected by the cleaning brush 42 during the image forming operation.

Also, the transferred, positively charged toner particles on the belt 30 are electrically attracted and collected by the bristles of the brush 42 during the toner transfer operation. As shown in FIG. 12, most of the transferred toner particles have positive polarity and therefore the substantial part thereof are collected by the cleaning brush 42 in the transfer operation.

A small part of the transferred toner particles may not be collected by the cleaning brush. The uncollected toner particles are then transported into the region from the opposing portion of the belt 30 and the second transfer roller 40 to another opposing portion of the belt 30 and the charging brush 74 without being transferred onto the recording medium or the second transfer roller during the transfer operation, which will be collected by the cleaning brush 42 during the subsequent image forming operation.

Other structures and advantages relating to the third embodiment are substantially the same as those described in the previous embodiments.

Post-Processing Sequence of Third Embodiment

Figure 10:
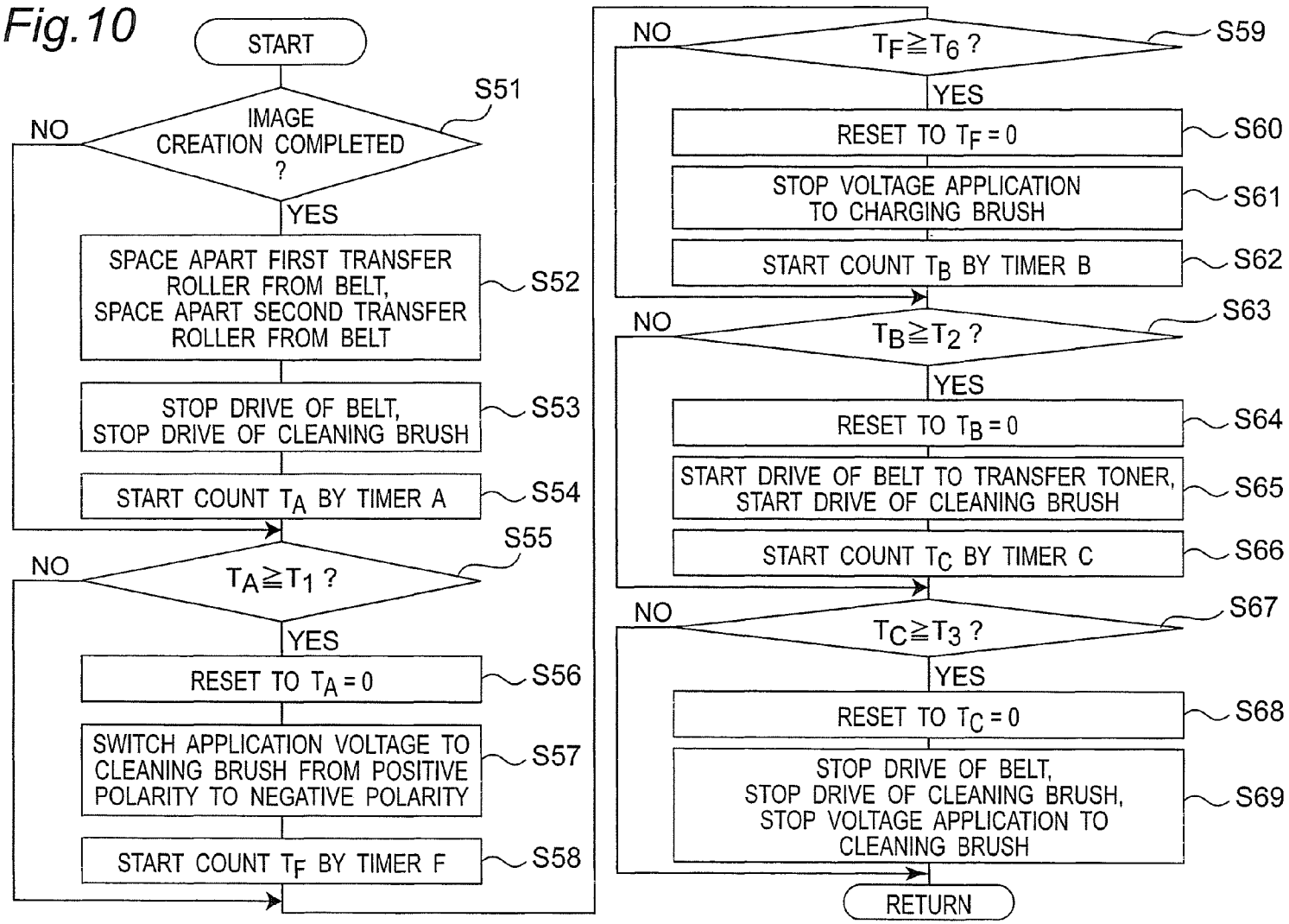
FIG. 10 is a flowchart showing the flow of process of a post-processing sequence according to the third embodiment.
Figure 11:
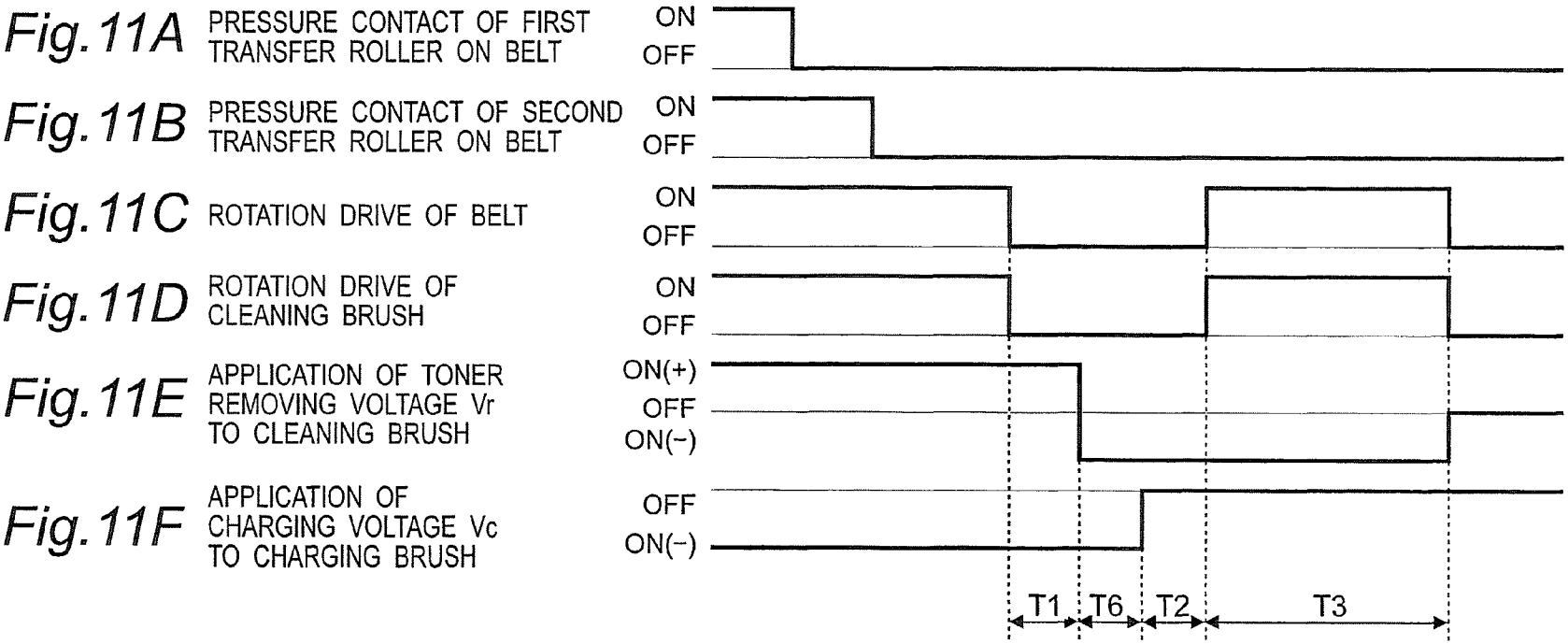
FIG. 11 is a time chart of control of various operations of the post-processing sequence according to the third embodiment.

Referring to FIGS. 10 and 11, the program flow of the post-processing sequence of the third embodiment will be described. It could be understood that the each of the operations in the main routine is the same as that of the first embodiment.

As shown in FIG. 10, when the post-processing operation is started, it is determined at step 51 whether the image forming operation has been completed. If yes, the first and second transfer rollers, 14 and 40, are spaced away from the belt 30 at step 52 (see FIGS. 11A and 11B), and the program proceeds to step 53. Otherwise, the program proceeds to step 55.

At step 53, the rotations of the belt 30 and the cleaning brush 42 are halted (see FIGS. 11C and 11D). Then, at step 54, a counter $T_A$ of the timer A starts counting.

It is determined at step 55 whether the counter $T_A$ of the timer A counts up a predetermined time $T_1$. The time $T_1$ is determined as described in the first embodiment.

If it is determined at step 55 whether the counter $T_A$ counts up the time $T_1$, the counter $T_A$ is reset to zero at step 56 and then the program proceeds to step 57. Otherwise, the program proceeds to step 59.

At step 57, the voltage Vr to be applied to the cleaning brush 42 is switched from the positive voltage level to the negative voltage level (see FIG. 11E), and the program proceeds to step 58.

The counter $T_F$ of the timer F starts counting at step 58, and it is determined at step 59 whether the counter $T_F$ counts up a predetermined time $T_6$. The time $T_6$ is set to be the one required for the voltage Vr to be substantially switched after the issuance of the instruction from the controller 70.

If it is determined at step 59 that the counter $T_F$ counts up the time $T_6$, the counter $T_F$ is reset to zero at step 60 and then the program proceeds to step 61. Otherwise, the program proceeds to step 63.

The application of the voltage Vc to the charging brush 74 is turned off (see FIG. 11F) at step 61, and then the program proceeds to step 62. This causes that the positively charged toner particles accumulated within the charging brush 74 lose electrical attraction force with the bristles of the brush 74, as described in the first embodiment.

The counter $T_B$ of the timer B starts counting at step 62 and then it is determined at step 63 whether the counter $T_B$ counts up the predetermined time $T_2$ which is determined as described in the first embodiment.

If it is determined at step 63 that the timer $T_B$ counts up the predetermined time $T_2$, the program proceeds to step 64 where the counter $T_B$ is reset to zero and then the program proceeds to step 65. Otherwise, the program proceeds to step 67.

For toner transfer operation, the rotations of the belt 30 and the cleaning brush 42 are started at step 65 (see FIGS. 11C and 11D), and then the program proceeds to step 66. This allows that the toner particles accumulated within the charging brush 74 are transferred onto the belt 30 as described in the first and second embodiments. Most of the transferred toner particles have positive polarity and therefore, when transported to the contact region of the belt 30 and the cleaning brush 42, they are collected by the brush 42 and thereby removed from the belt 30.

The counter $T_C$ of the timer C starts counting at step 66. It is then determined at step 67 whether the counter $T_C$ counts up the predetermined time $T_3$. The time $T_3$ is determined as described in the first embodiment.

If it is determined at step 67 that the counter $T_C$ counts up the time $T_3$, the counter $T_C$ is reset to zero at step 68 and then the program proceeds to step 69. Otherwise, the program returns to the main routine.

At step 69, the rotations of the belt 30 and the cleaning brush 42 are halted and the voltage Vr to the cleaning brush 42 is turned off (FIGS. 11C, 11D, and 11E). Afterwards, the program returns to the main routine.

The toner particles uncollected by the cleaning brush 42 stay on the belt portion extending from the opposing region of the belt 30 and the transfer roller 40 to another opposing region of the belt 30 and the charging brush 74 with respect to the rotational direction of the belt 30 when the rotation of the belt is halted. The uncollected, transferred toner particles on the belt 30 are then transported by the rotation of the belt 30 into the contact region of the belt and the charging brush 74 during the subsequent image forming operation, where they are charged with negative polarity by the contact with the charging brush 74 and therefore collected by the cleaning brush 42. This prevents the toner particle from being transferred onto the recording medium 36 from the belt 30 during the subsequent image forming operation.

Although the present invention has been fully described with the embodiments, it is not limited thereto.

For example, although the transfer operation is described in connection with the embodiments in each of which the endless intermediate belt 30 is used, the present invention is equally applicable to other embodiments in which the toner particles are transferred onto and collected from another type of image bearing members, rather than the intermediate belt 30, such as cylindrical drum-type intermediate transfer member and cylindrical and endless-belt type photosensitive member.

Further, although the charging brush 74 is electrically connected to the power supply 82 so as to apply the charge voltage to the charging brush 74, the present invention is not limited thereto. For example, the charging brush 74 may be grounded as described in JP 2004-310060 A, the entire disclosure of which being incorporated herein by reference. In this instance, simply by turning off the power supply 84 connected to the collecting roller 77 after the halt of the transfer belt 30, electric current to the charging brush 74 is turned off and, as a result, the negative voltage to be applied to the charging brush 74 is eliminated.

Furthermore, although the displacement of the belt 30 in the transfer operation is controlled by the use of the timer counter, it may be controlled in another way. For example, the displacement may be controlled by the use of an output of a pulse encoder mounted on the rotational portion or shaft of the roller or rollers supporting the belt 30. Alternatively, the displacement may be controlled by the use of a mark or indication provided on the outer periphery of the belt 30 and a detector for detecting the mark so that the controller controls the displacement upon receiving a signal from the detector indicative of the detection of the mark.

What is claimed is:

1. An image forming apparatus comprising:

an image bearing member, the image bearing member having an endless image bearing surface and supported for rotation;

a charging member made of a brush provided in contact with the image bearing surface to define a charging region;

a first transfer station having a first region in which a toner image is transferred onto the rotating image bearing surface, the first transfer region being located on a downstream side of the charging region with respect to a normal rotational direction of the image bearing member;

a second transfer station having a second transfer region in which the toner image is transferred from the rotating image bearing surface onto a recording medium passing therethrough, the transfer region being located on the downstream side of the first transfer region and on an upstream side of the charging region with respect to the normal rotational direction of the image bearing member; and a controller for controlling an image forming operation in which the toner image is provided to the image bearing surface at the first transfer region and provided to the recording medium at the second transfer region; and a transfer operation in which the rotation of the image bearing member is halted and then toner particles accumulated in the brush are transferred onto the image bearing surface at the charging region and the controller transports a portion of the image bearing surface to which the toner particles are transferred from the charging brush into a region extending from the second transfer region to the charging region with respect to the normal rotational direction.

2. The apparatus of claim 1 further comprising:

a cleaning member provided in contact with the image bearing surface to define a cleaning region on the downstream side of the charging region and on the upstream side of the first transfer region with respect to the normal rotational direction of the image bearing member; and wherein, in the subsequent image forming operation, the controller transports the portion of the image bearing member into the cleaning region where the toner particles are collected by the cleaning member.

3. The apparatus of claim 1 further comprising:

a first power source connected to the brush, the first power source being controlled by the controller so that in the image forming operation the first power source is turned on to provide a first voltage to the brush and thereby to provide the toner particles on the image bearing surface and passing through the charging region with electric charge of a first polarity and in the transfer operation the first power source is turned off to eliminate an electric attraction force between the brush and the toner particles accumulated within the brush and thereby to cause the toner particles accumulated within the brush to be easily released from the brush onto the image bearing surface.

4. The apparatus of claim 2 further comprising:

a second power source connected to the cleaning member, the second power source being controlled in the image forming operation by the controller so as to provide a second voltage with a second polarity opposite the first polarity, for electrically attracting the toner particles from the image bearing surface to the cleaning member.

5. The apparatus of claim 1, wherein the second transfer station has a second transfer member opposing the image bearing surface and capable of moving between a contact state in which the second transfer member is in contact with the image transfer surface and a non-contact state in which the second transfer member is out of contact with the image transfer surface, the second transfer member being kept in the contact state in the image forming operation and in the non-contact state in the transfer operation.

6. The apparatus of claim 1, wherein the image bearing member is rotated in the normal direction in the image forming operation and in the normal direction in the transfer operation.

7. The apparatus of claim 1, wherein the image bearing member is rotated in the normal direction in the forming operation and in the opposite direction in the transfer operation.

8. A method for controlling an image forming apparatus, the method having an image forming operation and a toner transfer operation to be performed before or after the image forming operation, the image forming operation including rotating an endless image forming member having an endless image bearing surface;

forming a toner image made of toner particles onto the image bearing surface, the toner particles having a first electric charge of a first polarity;

transferring the toner image onto a recording medium at a transfer region;

providing the first electric charge to a brush mounted in contact with the image bearing surface, charging the toner particles; and attracting and collecting the toner particles with a second electric charge of a second polarity opposite the first polarity by a cleaning member;

the transfer operation including halting a rotation of the image bearing member;

eliminating the first electric charge from the brush to release the toner particles from the brush onto the image bearing surface; and rotating the image bearing member for transporting a portion of the image bearing surface to which the toner particles are transferred from the brush into a region on an upstream side of the brush and on a downstream side of the transfer region with respect to the rotation of the image bearing member in the image forming operation.

9. An image forming apparatus comprising:

an image bearing member having an endless image bearing surface and supported for rotation;

a transfer station having a transfer region in which the toner image is transferred from the rotating image bearing surface onto a recording medium passing therethrough;

a charging member made of a brush provided in contact with the image bearing surface to define a charging region, the charging region being located on a downstream side of the transfer region with respect to the rotational direction of the image bearing member; and a controller for controlling an image forming operation in which the toner image is provided to the recording medium; and a transfer operation in which the rotation of the image bearing member is halted and then toner particles accumulated in the brush are transferred onto the image bearing surface at the charging region and the controller transports a portion of the image bearing surface to which the toner particles are transferred from the charging brush into a region extending from the transfer region to the charging region with respect to the rotational direction.

10. The apparatus of claim 9, wherein the controller transports the portion of the image bearing surface to which the toner particles are transferred from the charging brush into the region by rotating the image bearing member in the rotational direction.

11. The apparatus of claim 9 further comprising:

a power source connected to the charging member, the power source being controlled by the controller so that the power source is turned on in the image forming operation and the power source is turned off in the transfer operation.

12. The apparatus of claim 11, wherein the power source is controlled by the controller.

* * * * *